United States Patent [19]

Wakabayashi

[11] 4,424,749

[45] Jan. 10, 1984

[54] POWER-AND-FREE CONVEYOR

[75] Inventor: Takao Wakabayashi, Shinsenri-Minamimachi, Japan

[73] Assignee: Nakanishi Metal Works Co., Ltd., Osaka, Japan

[21] Appl. No.: 377,906

[22] Filed: May 13, 1982

[30] Foreign Application Priority Data

Feb. 10, 1982 [JP] Japan ..... 57/20063

[51] Int. Cl.[3] ..... B61B 10/02; B65G 17/00

[52] U.S. Cl. ..... 104/172 S; 104/96

[58] Field of Search ..... 104/172 S, 172 R, 96, 104/178, 249, 250, 91, 94, 95, 103, 89

[56] References Cited

U.S. PATENT DOCUMENTS

| | | | |
|---|---|---|---|
| 3,424,112 | 1/1969 | Orwin | 104/172 S |
| 3,559,585 | 2/1971 | Lempio | 104/172 S |
| 3,667,399 | 6/1972 | Czarnecki | 104/172 S |
| 4,073,237 | 2/1978 | Wakabayashi | 104/172 S |
| 4,148,261 | 4/1979 | Wakabayashi | 104/172 S |

*Primary Examiner*—Robert B. Reeves
*Assistant Examiner*—Richard Mathfeu
*Attorney, Agent, or Firm*—Armstrong, Nikaido, Marmelstein & Kubovcik

[57] ABSTRACT

An apparatus for transferring carriers from a first power line to a second power line through a power line discontinuous section. Each carrier has a dog engageable with each of the pivotable pushers on each of the power lines and a pusher raising cam having a dog receiving recess at its rear portion. The pusher includes a downward portion and a laterally extending horizontal portion at the lower end of the downward portion, the horizontal portion being formed with an upper pushing face and a lower pushing face on its front side and having a cavity in its bottom at the middle of the length thereof. The cam has a front lower portion, a rear higher portion having its top positioned at the same level as the top of the dog and a projection on the top of the front lower portion. The free line has a carrier standby section coextensive with the first power line near the discontinuous section and longer than the carrier. The standby section is laterally displaced from immediately below the first power line within a range permitting the horizontal portion of a pusher advancing from behind a carried at rest in the standby section to engage the projection of the cam on the carrier upon disengagement from the dog on the following carrier to transfer the standby carrier to the discontinuous section, after allowing the follower to stop in lapping relation to the preceding carrier.

5 Claims, 15 Drawing Figures

POWER-AND-FREE CONVEYOR

BACKGROUND OF THE INVENTION

The present invention relates to a power-and-free conveyor, and more particularly to an apparatus for use in such a conveyor for accumulating carriers and transferring the carrier from one power line to another through a power line discontinuous section.

Power-and-free conveyors are known which comprise first and second power lines arranged discontinuously, a free line coextensive with the two power lines therebelow along the power line discontinuous section, a multiplicity of pushers pivotally movable upward and downward and attached at a specified spacing to a drive chain on each of the power lines, a dog engageable with the pusher and mounted on each of a multiplicity of carriers on the free line, and a pusher raising cam mounted on each of the carriers and having a dog receiving recess at its rear portion.

Conventionally an apparatus, such as a carrier pushing hydraulic cylinder apparatus, which is separate from the conveyor is used for transferring the carrier from the first power line to the second through the power line discontinuous section. The apparatus requires a carrier stopping device to the rear of a standby section positioned along the first power line in the vicinity of the discontinuous section.

Accordingly it is presently desired to provide for the power line discontinuous section a carrier transfer apparatus which does not require any special apparatus or stopping device other than the power-and-free conveyor.

SUMMARY OF THE INVENTION

To meet the above demand, the present invention provides a carrier transfer apparatus for use in the power-and-free conveyor described above. The present apparatus is characterized in that the pusher includes a downward portion obliquely extending rearwardly downward and a horizontal portion provided at the lower end of the downward portion and extending laterally, the horizontal portion being formed with an upper pushing face and a lower pushing face on its front side and having a cavity in its bottom at the middle of the length thereof, the pusher raising cam having a front lower portion, a rear higher portion having its top positioned at a level not lower than the top of the dog and a projection corresponding to the cavity and provided on the top of the front lower portion at the middle of its width, the free line having a carrier standby section coextensive with the first power line in the vicinity of the power line discontinuous section, the standby section having a larger length than the carrier and being deviated from immediately below the first power line within such a range that the horizontal portion of a pusher which is advancing from behind a carrier at rest in the standby section is permitted to interfere with the projection of the cam on the carrier at rest, whereby a larger number of carriers sent forward to the terminal of the first power line can be transferred to the second power line one after another regularly and efficiently without necessitating any apparatus or stopping device other than the conveyor.

The invention will be described below in greater detail with reference to the accompanying drawings. dr

BRIEF DESCRIPTION OF THE DRAWINGS

FIG. 8 is a fragmentary side elevation showing the carrier and another carrier approaching the former from behind;

FIG. 9 is a view in section taken along the line IX—IX in FIG. 8;

FIG. 10 is a fragmentary side elevation showing the following carrier brought to a halt in lapping relation to the preceding carrier, with a pusher disengaged from the dog on the following carrier and positioned on a rear higher portion of the cam on the preceding carrier;

FIG. 11 is a view in section taken along the line XI—XI in FIG. 10;

FIG. 12 is a fragmentary side elevation showing the carriers, with the pusher in engagement with a projection on a front lower portion of the cam;

FIG. 13 is a view in section taken along the line XIII—XIII in FIG. 12;

DESCRIPTION OF THE PREFERRED EMBODIMENT

Figure 1:
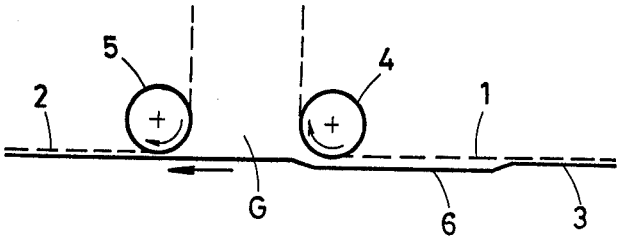
FIG. 1 is a plan view schematically showing an improved power-and-free conveyor of the invention including first and second power lines and a free line having a standby section.

FIG. 1 shows first and second power lines 1 and 2 arranged discontinuously and a free line 3 coextensive with the two lines 1 and 2 therebelow through the power line discontinuous section G. The first power line 1 is turned laterally away from the free line 3 at the position of a sprocket wheel 4 having a drive chain reeved therearound. The second power line 2 extending laterally is turned into alignment with the free line 3 at the position of a sprocket wheel 5 similarly provided with a drive chain. Although the free line 3 shown is slightly out of alignment with the first and second power lines 1, 2 for a better understanding, the free line 3 extends immediately below the lines 1, 2 except at the carrier standby section 6 to be described later.

Figure 2:
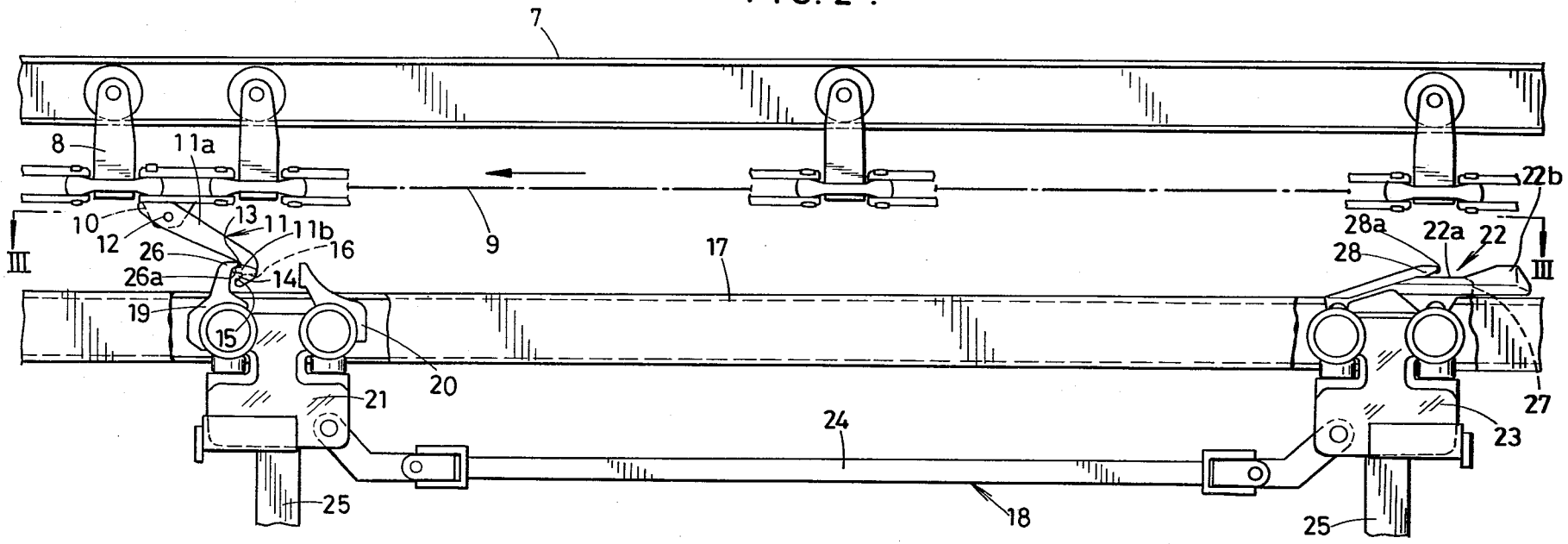
FIG. 2 is a side elevation showing a carrier of the conveyor travelling on the free line in a usual section, with a free rail partly broken away.
Figure 3:
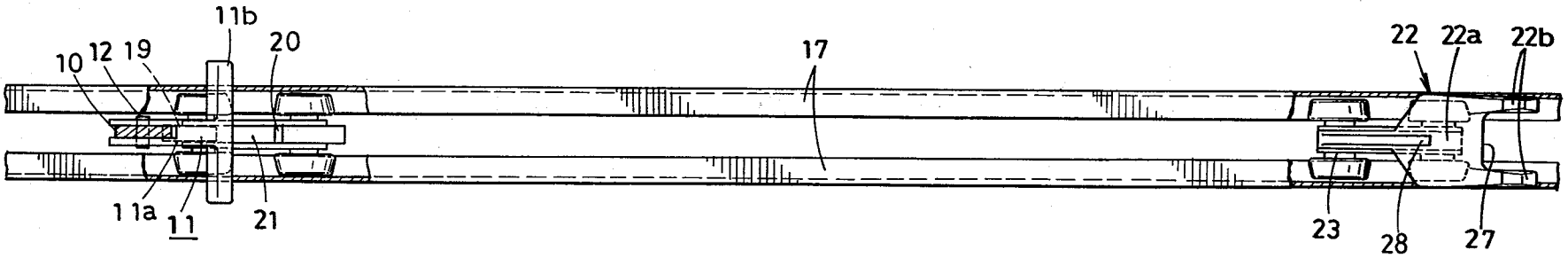
FIG. 3 is a view in section taken along the line II—II in FIG. 2, with free rails shown as partly broken away.

FIGS. 2 and 3 show a carrier 18 travelling in a usual section of the conveyor line other than the power line discontinuous section G and the carrier standby section 6. A power rail 7 is made of a steel bar of I-shaped cross section and has a drive chain 9 suspended therefrom by a large number of power trolleys 8. The drive chain 9 is driven by unillustrated electric motor and transmission means at all times in the direction of arrow shown in FIG. 2. The drive chain 9 has attached thereto a multiplicity of brackets 10 projecting downward and arranged at a specified spacing. A pusher 11 includes a downward portion 11*a* supported at its upper end by a pivot 12 on each of the brackets 10 and movable upward and downward. The downward portion 11*a* of the pusher 11 obliquely extends rearwardly downward and is provided at its lower end with a horizontal portion 11*b* extending laterally. When seen sidewise, the horizontal portion 11*b* slightly extends forwardly downward obliquely and has a slanting upper surface serving as an upper pushing face 13. Under the upper pushing face 13, a laterally V-shaped groove 14 is formed horizontally in the front side of the horizontal portion 11*b*. The slanting lower surface defining the groove 14 serves as a lower pushing face 15. A cavity 16 is formed in the bottom of the horizontal portion 11*b* at the middle of its length.

Free rails 17 spaced apart by a predetermined distance are arranged below the power rail 7. The free rails 17 are in the form of a pair of steel channel bars opposed to each other.

The carrier 18 comprises a front free trolley 21 movable on the free rails 17 and having a pair of front and rear tilting dogs 19, 20, a rear free trolley 23 having a pusher raising cam 22 at its upper end and a connecting bar 24 interconnecting the two free trolleys 21, 23. A hanger 25 is attached to the lower end of each of the free trolleys 21, 23. The front dog 19 is tiltable only rearward, while the rear dog 20 is tiltable only forward. The front tilting dog 19 is provided at its upper end with a beaked rearward projection 26 having a slanting lower face 26*a*. The pusher 11 engages the front tilting dog 19 with the slanting lower face 26*a* in bearing contact with the upper pushing face 13. The cam 22 has a front lower portion 22*a* and a rear higher portion 22*b*. The top of the rear higher portion 22*b* is at the same level as the top of the front tilting dog 19 but may be at a slightly higher level than the latter. The cam 22 has a dog receiving recess 27 at its rear portion. A projection 28 corresponding to the cavity 16 is provided on the top of the front lower portion 22*a* of the cam 22 at the middle of its width. The projection 28 has a rear end resembling the rearward projection 26 of the front tilting dog 19 in shape, i.e. projecting rearward in the form of a beak, and formed with a slanting lower face 28*a* engageable with the lower pushing face 15. The projection 28 is inclined in parallel with a front slope of the front lower portion 22*a* of the cam 22.

The carrier standby section 6 shown in FIG. 1 has a larger length than the carrier 18 and is displaced laterally from immediately below the first power line 1 within such a range that the horizontal portion 11*b* of a pusher 11 which is advancing from behind a waiting carrier 18 at rest in the standby section 6 is permitted to interfere with the projection 28 of the cam 22 on the waiting carrier 18.

With reference to FIGS. 2 and 3, the carrier 18 is moved with the drive chain 9 in the direction of arrow by the engagement of the pusher 11 with the dog 19 on its front free trolley 21 from behind. Although not shown, a large number of carriers follow this similarly at a predetermined spacing which is dependent on the spacing of the pushers 11 suspended from the drive chain 9.

Figure 4:
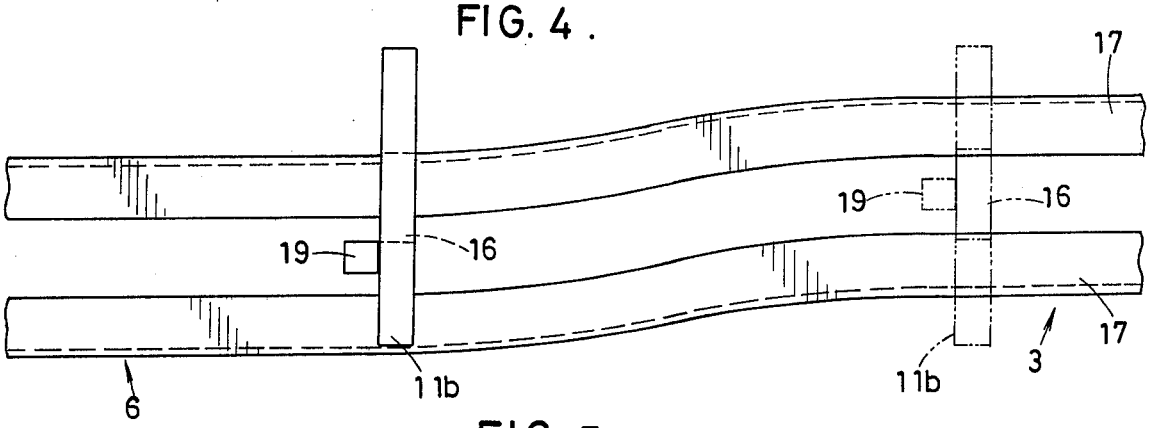
FIG. 4 is a fragmentary plan view showing the free line including part of the standby section and schematically showing the position of a pusher relative to a dog with which it is engageable.
Figure 5:
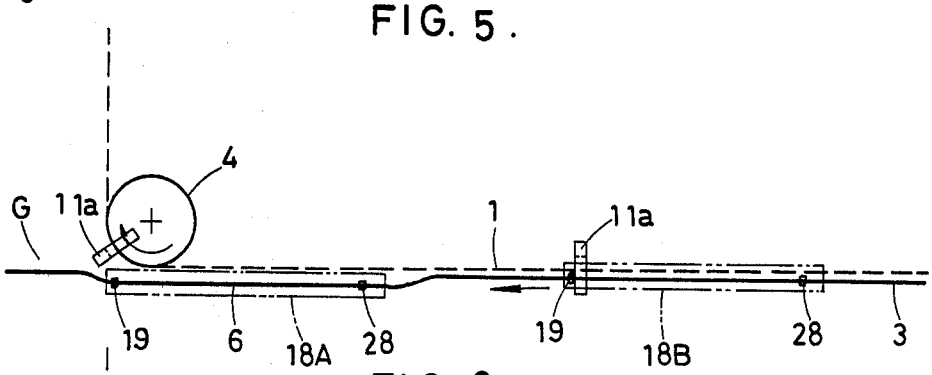
FIGS. 5 to 7 are enlarged fragmentary plan views of FIG. 1 successively showing positions of the carrier when it is sent out from the standby section into a power line discontinuous section.

The first carrier 18A advancing on the free line 3 in FIG. 5 enters the standby section 6 in the vicinity of the terminal of the first power line 1. FIG. 4 shows the position of the dog 19 relative to the horizontal portion 11*b* of the pusher 11 at this time. As indicated in broken lines in the same drawing, the dog 19 is positioned at the middle of the length of the pusher horizontal portion 11*b* in the usual section of the free line 3, but when the carrier 18A is in the standby section 6 which is laterally displaced from immediately below the first power line 1, the dog 19 is deviated from the middle of the horizontal portion 11*b* as indicated in solid lines in FIG. 4. However, the carrier 18A advances with the pusher 11 still held in engagement with the dog 19. When reaching the terminal of the first power line 1, the pusher 11 releases the dog 19 from its horizontal portion 11*b* since the pusher 11 is attached to the drive chain 9 moving forward as turned through 90° by the sprocket wheel 4 as shown in FIG. 5. To assure smooth release of the dog, it is desirable to provide a cam-like lift at the front end of the standby section 6 on either side thereof for lifting the pusher horizontal portion 11*b* out of engagement with the dog 19. When the pusher 11 is disengaged from the dog 19, the carrier 18A spontaneously comes to a halt in the standby section 6.

Figure 7:
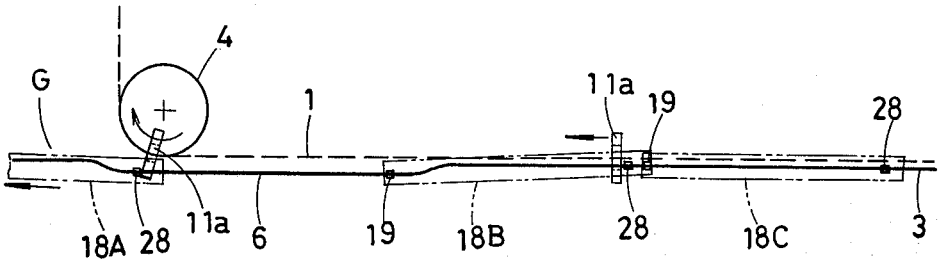
Figure 8:
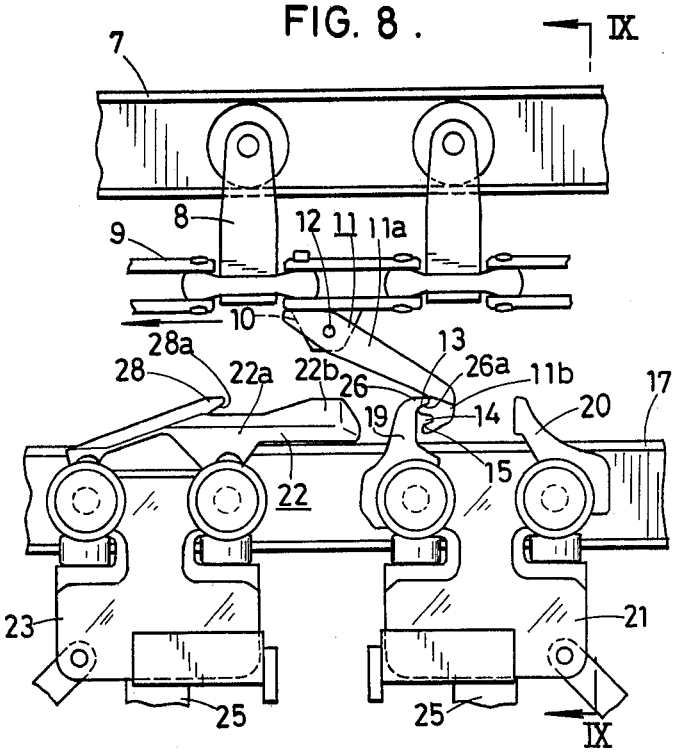
FIGS. 8 to 13 show how the carrier is sent into the discontinuous section when it is at rest in the standby section.
Figure 9:
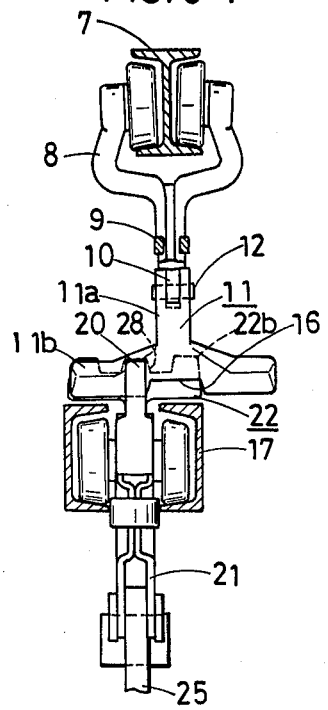
Figure 10:
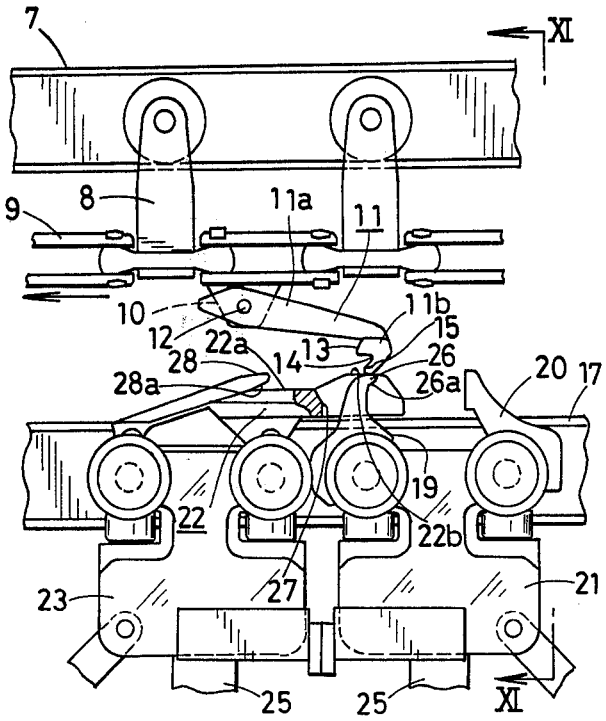
Figure 11:
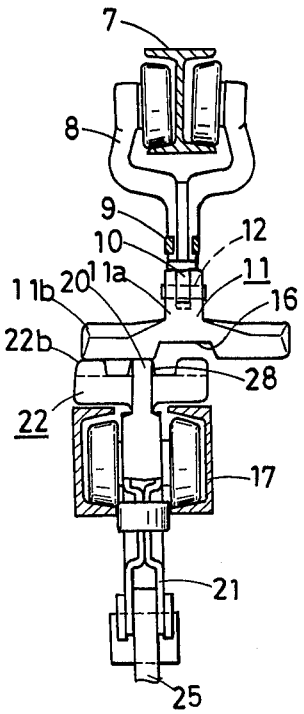
Figure 12:
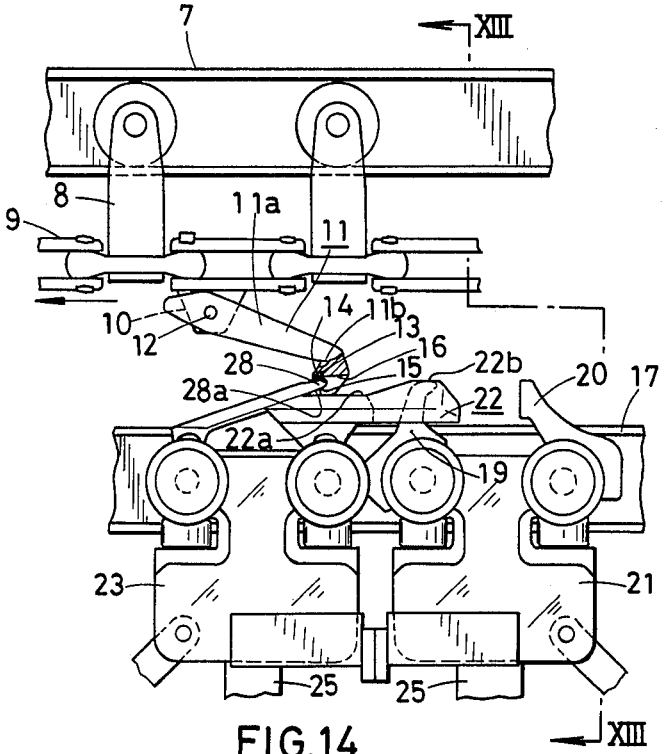
Figure 13:
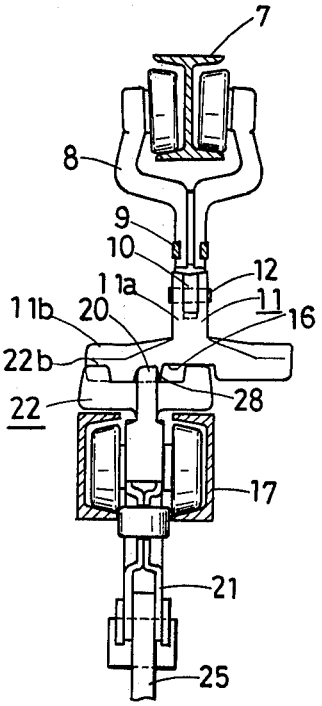

After the first carrier 18A has stopped, the second and following carriers continue to travel with the drive chain 9 (see FIGS. 8 and 9). When the dog 19 of the second carrier 18B is received in the recess 27 of the cam 22 on the first carrier 18A, the pusher 11 in engagement with this dog 19 has its horizontal portion 11*b* raised by sliding contact with the rear slope of the rear higher portion 22*b* of the cam 22 and is disengaged from the dog 19 at the top of the portion 22*b*. Consequently the second carrier 18B comes to a halt in lapping relation to the first carrier 18A (see FIGS. 10 and 11). The pusher 11 further advances from the rear higher portion 22*b* of the cam 22 to its front lower portion 22*a*. At this time, the cavity 16 formed in the horizontal portion 11*b* of the pusher 11 is laterally at a distance from the center line of the cam 22, i.e. from the projection 28 on the front lower portion 22*a*. As a result, the lower pushing face 15 of the horizontal portion 11*b* comes into contact with the slanting lower face 28*a* of the projection 28 for the engagement of the pusher 11 with the projection 28 (see FIGS. 6, 12 and 13). With the travel of the drive chain 9, therefore, the first carrier 18A is sent out from the standby section 6 into the power line discontinuous section G (see FIG. 7). The length of the discontinuous section G is such that a pusher 11 on the second power line 2 is engageable with the dog 19 on the carrier 18 from behind when the carrier 18 stops or immediately before the carrier stops after the pusher horizontal portion 11*b* disengages from the projection 28 due to the change of direction of the first power line 1. Accordingly the first carrier 18A transferred to the power line discontinuous section G by the driving force of the first power line 1 is subsequently advanced through the section G by the driving force of the second power line 2 and brought to a location on the free line 3 immediately below the second power line 2.

Figure 6:
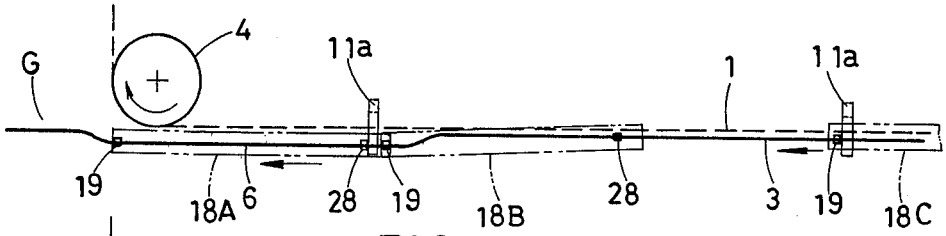
Figure 14:
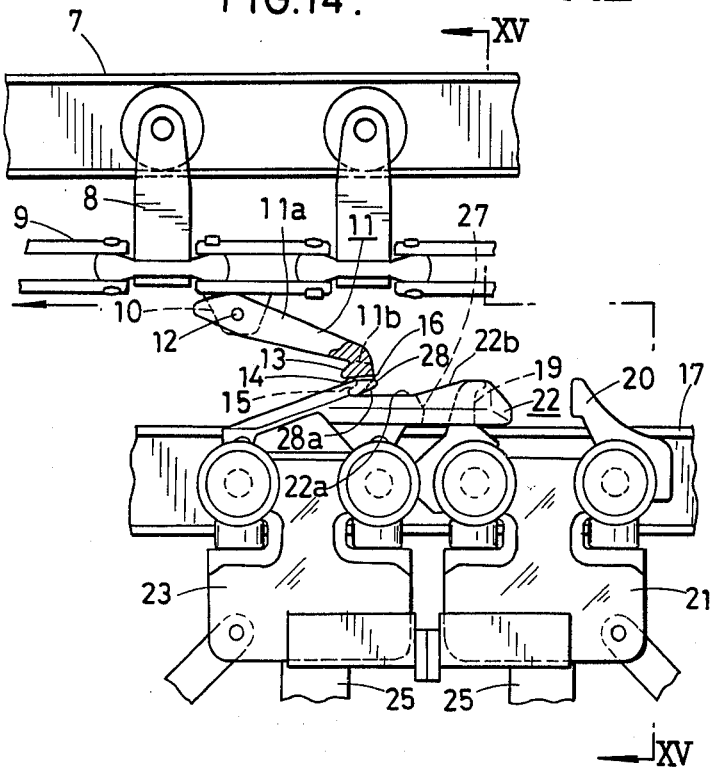
FIG. 14 is a fragmenary side elevation showing a pusher passing over a projection on a front lower portion of the cam of the following carrier at rest in the standby section after the pusher is disengaged from the dog of another carrier which has been forward into the standby section by the pusher from a stopped position some distance away from the section.
Figure 15:
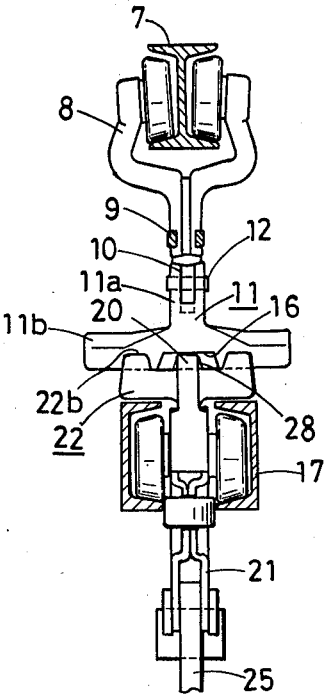
FIG. 15 is a view in section taken along the line XV—XV in FIG. 14.

The third carrier 18C approaches the second carrier 18B from behind, the second carrier 18B being at rest with its front end positioned in the standby section 6 (see FIG. 6). When the dog 19 on the third carrier 18C is received in the recess 27 of the cam 22 on the second carrier 18B, the pusher 11 advancing the third carrier 18C is disengaged from the dog 19, permitting the third carrier 18C to stop in the same manner as when the second carrier 18B comes to a halt. However, it is to be noted that the cam 22 on the second carrier 18B is positioned in the usual section of the free line 3, so that the projection 28 on the front lower portion 22*a* of the cam 22 is on the path of movement of the cavity 16 in the horizontal portion 11*b* of the pusher 11. The pusher 11 therefore moves past the cam 22 without striking against the projection 28 (see FIGS. 14 and 15), further passes over the rear dog 20 on the second carrier 18B by pushing down the dog 20 and comes into engagement with the front dog 19 from behind, with the result that the second carrier 18B is transferred to the standby section 6. The carrier 18B is temporarily stopped in the section 6 before being transferred to the discontinuous section G as is the case with the first carrier 18A. The same procedure as above is thereafter repeated to transfer the following carriers 18 to the power line discontinuous section G one after another. Carriers are accumulated in the usual section of the free line 3 in the mode shown in FIGS. 14 and 15. A device may be provided at some distance from the standby section 6 for stopping the carrier in the section.

What is claimed is:

1. In a power-and-free conveyor comprising first and second power lines arranged discontinuously, a free line coextensive with the two power lines therebelow through the power line discontinuous section, a multiplicity of pushers pivotally movable upward and downward and attached at a specified spacing to a drive chain on each of the power lines, a dog engageable with the pusher and mounted on each of a multiplicity of carriers on the free line. and a pusher raising cam mounted on each of the carriers and having a dog receiving recess at its rear portion, the improvement comprising the pusher including a downward portion obliquely extending rearwardly downward and a horizontal portion provided at the lower end of the downward portion and extending laterally, the horizontal portion being formed with an upper pushing face and a lower pushing face on its front side and having a cavity in its bottom at the middle of the length thereof, the cam having a front lower portion, a rear higher portion having its top positioned at a level not lower than the top of the dog and a projection corresponding to the cavity and provided on the top of the front lower portion at the middle of its width, the free line having a carrier standby section coextensive with the first power line in the vicinity of the power line discontinuous section, the standby section having a larger length than the carrier and being laterally displaced from immediately below the first power line within a range permitting the horizontal portion of a pusher advancing from behind a carrier at rest in the standby section to interfere with the projection of the cam on the carrier at rest.

2. A power-and-free conveyor as defined in claim 1 wherein the dog is provided at its upper end with a beaked rearward projection having a slanting lower face engageable with the upper pushing face formed on the horizontal portion of the pusher.

3. A power-and-free conveyor as defined in claim 1 wherein the horizontal portion of the pusher extends obliquely downward, and the upper pushing face is a slanting upper surface formed on the horizontal portion.

4. A power-and-free conveyor as defined in claim 1 wherein the projection has a rear end projecting rearward in the form of a beak and formed with a slanting lower face engageable with the lower pushing face formed on the horizontal portion of the pusher.

5. A power-and-free conveyor as defined in claim 1 wherein the lower pushing face is a slanting lower surface defining a laterally V-shaped groove formed in the front side of the pusher horizontal portion and positioned under the upper pushing face.

* * * * *